US009831025B2

(12) United States Patent
Peinbauer et al.

(10) Patent No.: US 9,831,025 B2
(45) Date of Patent: Nov. 28, 2017

(54) EXPANSION RADIATOR FOR A HERMETICALLY CLOSED ELECTRICAL TRANSFORMER

(71) Applicant: SIEMENS AKTIENGESELLSCHAFT, Munich (DE)

(72) Inventors: Richard Peinbauer, Arnreit (AT); Martin Weniger, Amstetten (AT)

(73) Assignee: Siemens Aktiengesellschaft, Munich (DE)

( * ) Notice: Subject to any disclaimer, the term of this patent is extended or adjusted under 35 U.S.C. 154(b) by 210 days.

(21) Appl. No.: 14/651,397

(22) PCT Filed: Dec. 12, 2012

(86) PCT No.: PCT/EP2012/075233
§ 371 (c)(1),
(2) Date: Jun. 11, 2015

(87) PCT Pub. No.: WO2014/090296
PCT Pub. Date: Jun. 19, 2014

(65) Prior Publication Data

US 2015/0325358 A1 Nov. 12, 2015

(51) Int. Cl.

| | |
|---|---|
| ***H01F 27/10*** | (2006.01) |
| ***H01F 27/08*** | (2006.01) |
| ***F28D 15/00*** | (2006.01) |
| ***H01F 27/14*** | (2006.01) |
| ***H01F 27/02*** | (2006.01) |
| ***F28F 13/06*** | (2006.01) |

(Continued)

(52) U.S. Cl.
CPC ..... *H01F 27/14* (2013.01); *F28D 1/0316* (2013.01); *F28D 1/0358* (2013.01); *F28F 13/06* (2013.01); *H01F 27/022* (2013.01); *F28D 2021/0031* (2013.01); *F28D 2021/0049* (2013.01)

(58) Field of Classification Search
USPC ..... 336/55–58; 165/104.33
See application file for complete search history.

(56) References Cited

U.S. PATENT DOCUMENTS 1,568,727 A * 1/1926 Frank ..... H01F 27/12 165/104.33
4,469,269 A * 9/1984 Ito ..... H01F 27/025 228/173.6

(Continued)

FOREIGN PATENT DOCUMENTS

DE 1078146 A 3/1960
DE 10010737 C2 1/2002

(Continued)

*Primary Examiner* — Tsz Chan
*Assistant Examiner* — Kazi Hossain
(74) *Attorney, Agent, or Firm* — Laurence Greenberg; Werner Stemer; Ralph Locher

(57) ABSTRACT

An expansion radiator for a hermetically closed electrical transformer or a throttle. A heat exchange fluid is delivered to the radiator via an inflow, passed through an expansion shaft cavity formed by an expansion shaft and an associated cover part, and then drained off via an outflow. A flow guiding part which steers a flow direction of the heat exchange fluid is arranged in a mouth region between the inflow and the expansion shaft cavity.

10 Claims, 4 Drawing Sheets

(51) Int. Cl.
*F28D 1/03* (2006.01)
*F28D 21/00* (2006.01)

(56) References Cited

U.S. PATENT DOCUMENTS

| | | | | | |
|---|---|---|---|---|---|
| 5,205,349 | A * | 4/1993 | Nagao | B60H 1/00328 | 165/153 |
| 7,795,877 | B2 * | 9/2010 | Radtke | G01R 19/16547 | 324/530 |
| 2006/0042782 | A1 * | 3/2006 | Chen | H01L 23/467 | 165/80.3 |
| 2006/0250776 | A1 * | 11/2006 | Abul-Haj | F28F 3/02 | 361/710 |
| 2006/0283579 | A1 * | 12/2006 | Ghosh | H01L 23/473 | 165/104.33 |

FOREIGN PATENT DOCUMENTS

| | | | |
|---|---|---|---|
| DE | 102009015377 | B4 | 12/2011 |
| DK | DE102009015377 | * | 1/2010 |
| JP | 55115309 | A | 9/1980 |

* cited by examiner

FIG 4 Section P-P

EXPANSION RADIATOR FOR A HERMETICALLY CLOSED ELECTRICAL TRANSFORMER

TECHNICAL FIELD

The invention relates to an expansion radiator for a hermetically sealed electrical transformer or a choke, to which expansion radiator a heat exchange fluid is supplied via an inflow means, passed through an expansion corrugation cavity formed by an expansion corrugation and an associated cover part, and then drained via outflow means.

PRIOR ART

Electrical transformers or chokes of the type used in power distribution systems are usually cooled using an insulating oil. In order to compensate the oil volume fluctuations occurring during operation, an equalizing vessel is provided in the top of the transformer tank. In this equalizing vessel, contact with the ambient air causes an increase in moisture and oxygen in the insulating oil in spite of dehumidifiers, thereby accelerating the aging process and reducing the service life of the insulating paper. In order to counteract this accelerated aging process of the insulating paper it is also known to seal off the transformer hermetically from the external environment.

To compensate volume and pressure fluctuations, cooling devices known as expansion radiators are used which are connected to the transformer tank by connecting pipes and can absorb a particular range of variation in the oil volume by bulging of their cooling elements. However, an expansion radiator cannot of course be constructed to compensate an expansion volume of any size, but only a maximum expansion volume associated with its structural shape.

A transformer cooling device in which individual radiator elements equalize fluctuating volumes by bulging is known from DE 100 10 737 C2, for example. It is comprised of two sheet metal sections provided with a plurality of grooves, wherein the two sheet metal sections are interconnected/welded at the edges and are additionally interconnected by welds in the grooves. In contrast to conventional radiators, the two metal sections are only interconnected at every second groove in order to obtain a greater expansion volume, and without loss of mechanical stability. In order to achieve the most efficient cooling possible, in DE 10 2005 002 005 B4 the bulges are limited using a spacer strip. In both embodiments the two sheet metal sections of the radiator elements are welded circumferentially to one another, making them costly to manufacture.

In comparison thereto, DE 10 2009 015 377 B4 discloses a more easily manufacturable cooling radiator consisting of a supporting sheet and a single corrugated sheet. The individual corrugations are supplied with heat exchange fluid (coolant) by collecting ducts, so-called collectors. However, said coolant does not flow immediately in the direction of the nose of the sheet metal sections, but obliquely downward into the cavity of an expansion corrugation. As a result, however, the upper part of the corrugated sheet only contributes to the cooling effect to a reduced extent.

SUMMARY OF THE INVENTION

The object of the present invention is to specify an expansion radiator for a hermetically sealed electrical transformer or a choke, said expansion producing a better cooling effect but at the same time being inexpensive to manufacture.

This object is achieved by an expansion radiator as claimed. Advantageous further developments of the invention are defined in the dependent claims.

According to the invention, the expansion radiator has expansion corrugations, each having a flow guiding part disposed in the orifice region. The flow guiding part directs the inflowing heat exchange fluid toward the outer edge as it enters the cavity of the expansion corrugation, i.e. toward the nose of the expansion corrugation. As a result, the cooling effect of the upper part of the radiator located close to the collector is comparatively greater. A better cooling effect in turn means overall that the operating temperature of the transformer oil is lower. Consequently, the range of variation for the oil volume in the transformer tank is reduced. However, a smaller volume fluctuation means that less bulging of the radiator is required. Material fatigue and stress of the joints of the individual parts of the expansion radiator are therefore lower, and/or a greater dissipation can be handled. This is advantageous in terms of service life. It is particularly advantageous that the flow guiding part can be easily incorporated into the manufacture of the collector, so that the total costs for the expansion radiator according to the invention can be kept comparatively low.

A preferred embodiment of the expansion radiator can be designed such that the flow guiding part is implemented such that the cross section of the flow guiding part projecting into the expansion corrugation decreases, viewed toward the side with respect to the out flowing collector. This causes the cooling medium to be efficiently directed in the direction of the nose, but with the further fluid flow being subject to a slight flow resistance. This effect of initial flow guidance in the direction of the nose and subsequent flow in the direction of a side of an expansion corrugation can be implemented by different shaping of the flow guiding part.

In a particularly preferred embodiment of the invention, the flow guiding part projecting into the cavity of the expansion corrugation can be a plate-like, e.g. trapezoidally shaped metal part.

In another preferred embodiment, the flow guiding part projecting into the cavity of the expansion corrugation can taper toward the nose, e.g. in the shape of a wedge.

In a most particularly preferred embodiment, the flow guiding part is planarly trapezoidal and its cross-section is made to taper toward the nose.

It is also conceivable for the flow guiding part to be implemented as a cone or similar. It is merely important that the guiding element projects into the expansion corrugation and directs the inflowing transformer oil toward the outer edge side where the heat dissipation is particularly good.

In terms of the manufacturing costs, it is particularly advantageous if the expansion radiator consists of two rows of expansion corrugations, wherein each expansion corrugation row is constituted by a single corrugated sheet welded to a cover sheet.

The expansion radiator according to the invention can be advantageously used for distribution transformers in power grids.

BRIEF DESCRIPTION OF THE DRAWINGS

For further explanation of the invention, reference will be made in the following part of the description to drawings illustrating further advantages, embodiments, details and effects of the invention using non-limiting examples and in which.

DESCRIPTION OF PREFERRED EMBODIMENTS

Figure 1:
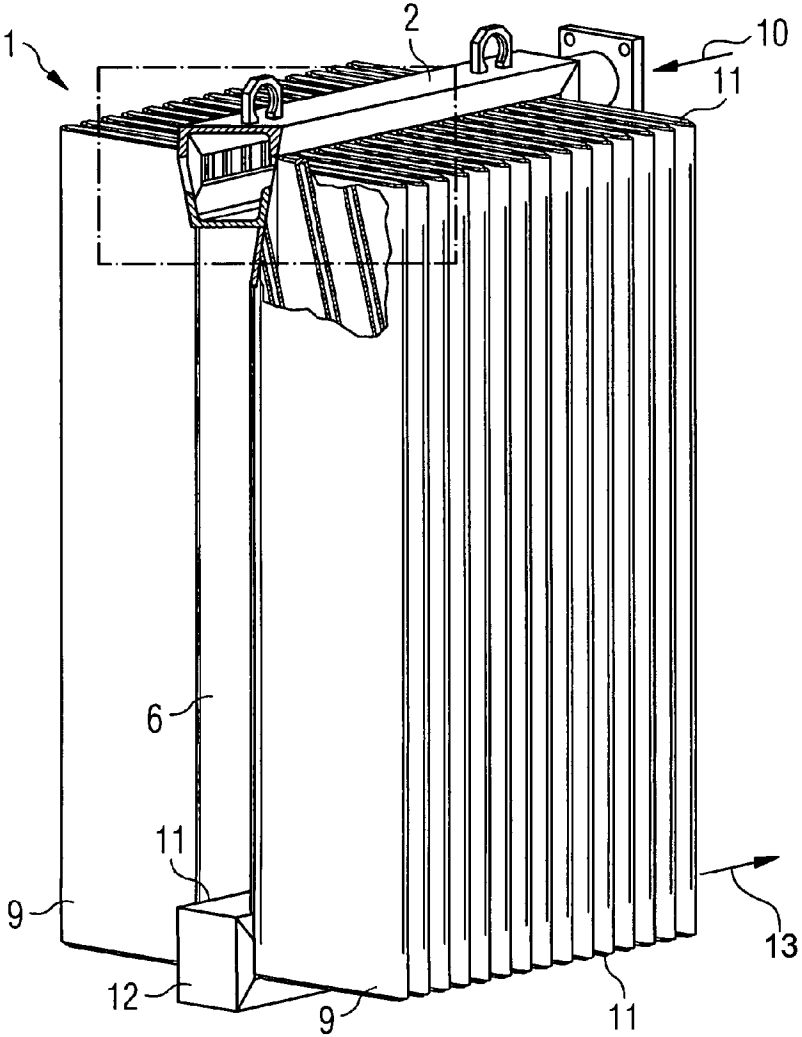
FIG. 1 shows a perspective view of an expansion radiator according to the invention.

FIG. 1 shows a perspective view of an expansion radiator 1 according to the invention. The expansion radiator 1 basically consists of two rows of expansion corrugations 9, each disposed on either side of an upper collector 2 and a lower collector 12. The backs of the expansion corrugations 9 are welded to a cover sheet 6 by means of a welded joint 11 in the inside area between the two collectors 2, 12. The sides of the expansion corrugation are likewise welded top and bottom in a liquid-tight manner. The cross-section of the collector 2 is rectangular in the example shown and leads into a circular pipe having a flange for connection to a transformer or a choke. During operation, the heat exchange medium (insulating oil, e.g. transformer oil) flows into this flange in the direction of the arrow 10 and leaves the expansion radiator 1 at its lower collector 12. The structural design is symmetrical with respect to an imaginary central plane running through the collectors 2, 12. Both of the expansion corrugations 9 are made from a single corrugated sheet (folded sheet). In a practical example of a distribution transformer, an expansion corrugation (cooling fin) protrudes some 100 to 300 mm, has a thickness of approximately 10 mm (in the case of a sheet thickness of approx. 1 mm) and has a spacing of approximately 50 mm. Each expansion corrugation 9 encloses an elongated expansion corrugation cavity 7, viewed in longitudinal direction of the expansion corrugation (see FIG. 5). This cavity 7 is welded in a liquid-tight manner at the end and, as already stated, is connected to the upper and lower collector in a liquid-conveying manner 2, 12 (inlet and outlet).

In an expansion radiator, each expansion corrugation 9 has a dual function: on the one hand, the heat transported there by the cooling medium during operation of the transformer/choke shall be dissipated to the environment; on the other, any operationally related fluctuation of the pressure in the hermetically sealed transformer tank shall be compensated. This compensation of the oil volume or rather of the oil pressure is accomplished by a corresponding elastic dimensional change in the expansion corrugation 9. Each expansion corrugation 9 is constructed like a kind of cushion. Overpressure in the transformer tank causes the cushion to bulge. In respect of volume compensation it is advantageous if the expansion corrugation 9 itself is made of an elastic, easily yielding material. In FIG. 1 the upper collector 2 is cut away in the region of a detail "M".

Figure 2:
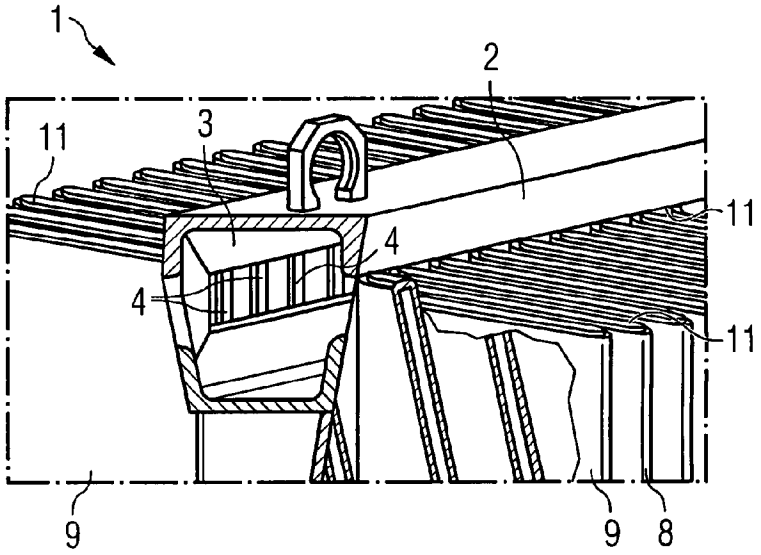
FIG. 2 shows the expansion radiator according to detail "M" in FIG. 1.

FIG. 2 shows an enlarged view of the detail "M" of FIG. 1. The sectional view reveals orifice regions 4 in the collector cavity 3. The transformer oil flows into an expansion corrugation 9 through each of these orifice regions 4, wherein according to the invention this flow is directed by a flow guiding part 5 (FIG. 4) toward the outer edge, i.e. the bend of the corrugated sheet, the nose 8. The partially cut away representation in FIG. 2 also shows that the collector 2 is constituted by two U-sections with their legs aligned to one another.

Figure 3:
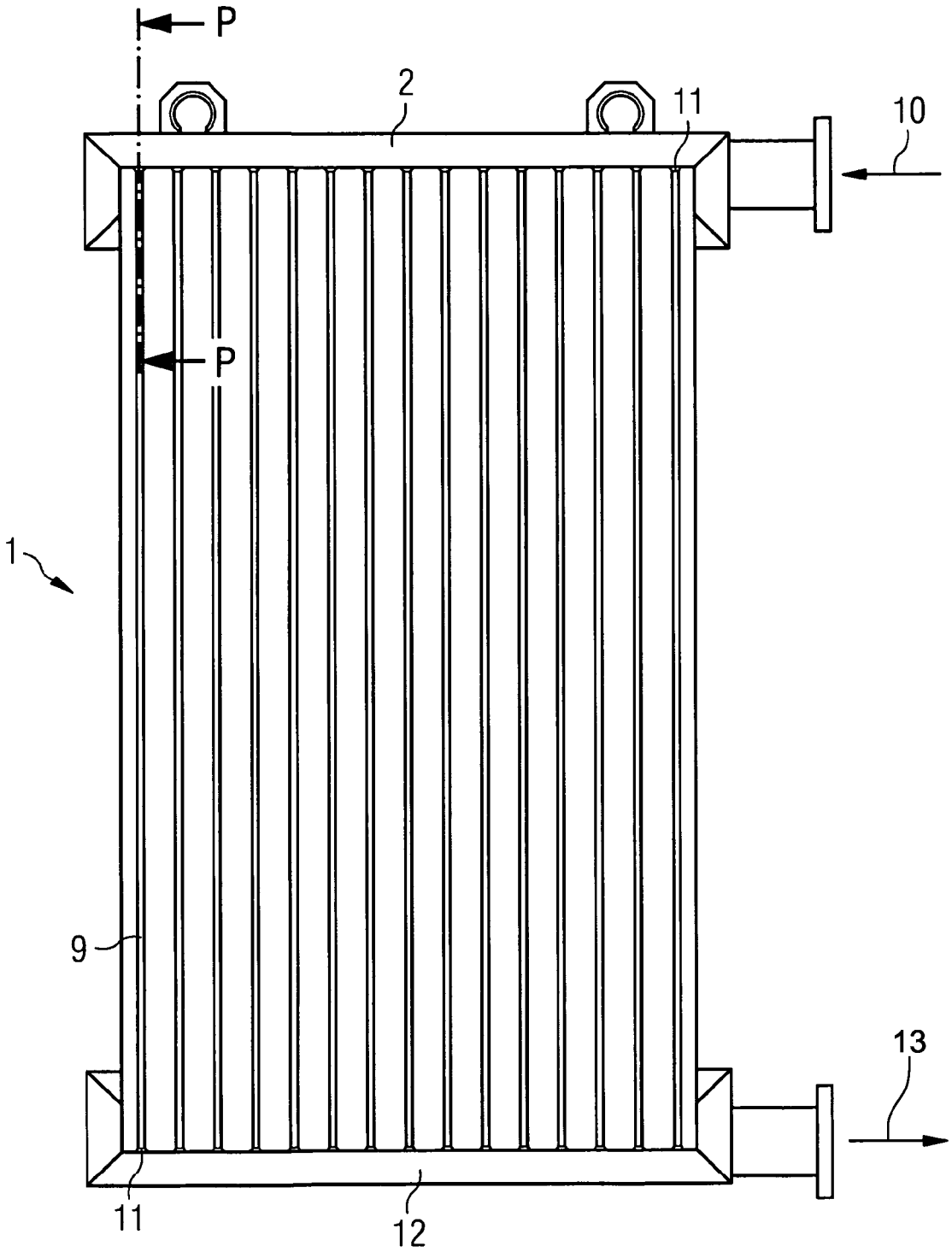
FIG. 3 shows a side view of the expansion radiator according to FIG. 1.

FIG. 3 shows a side view of the expansion radiator 1 according to the invention.

Figure 4:
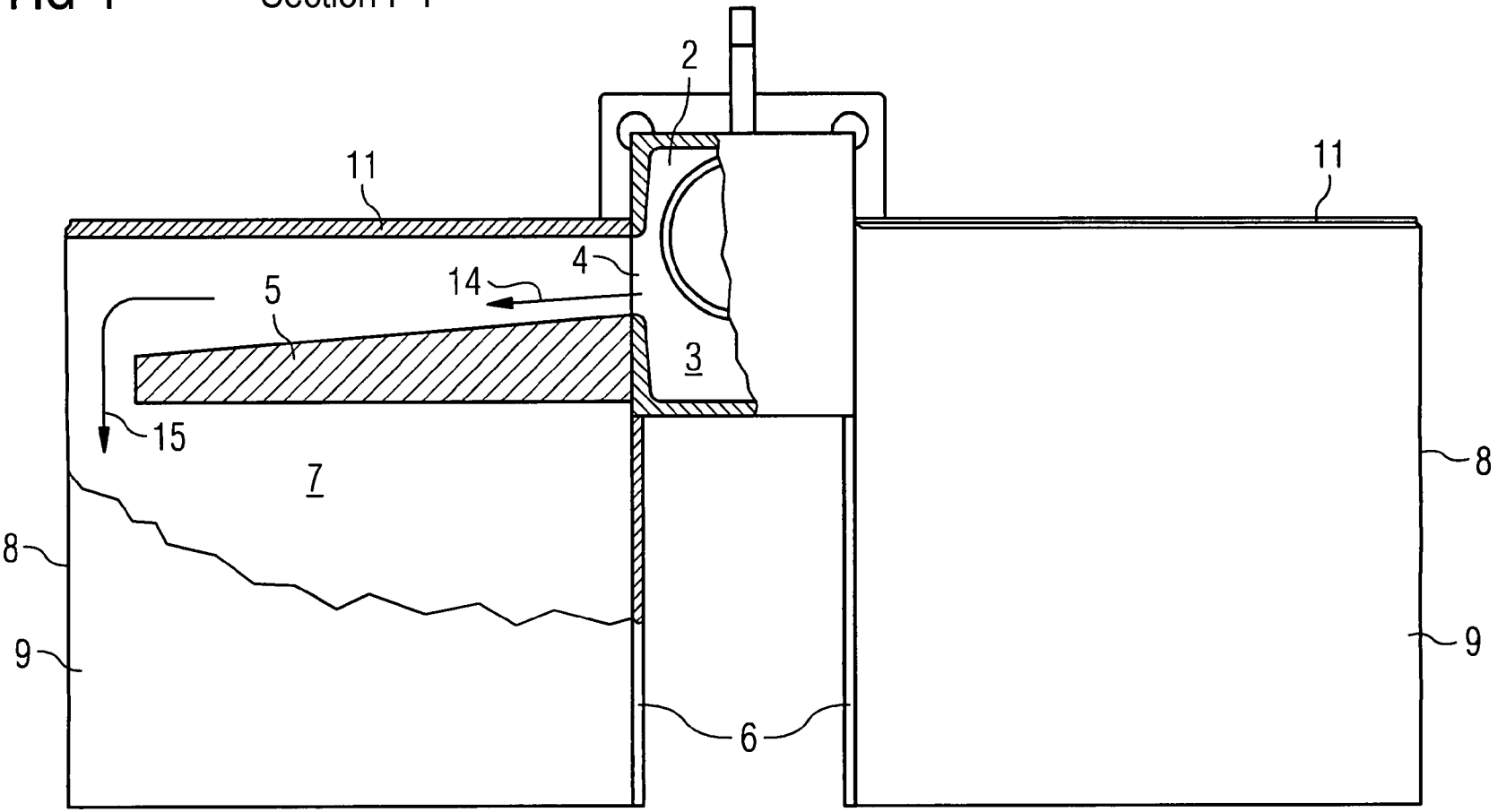
FIG. 4 shows a detail view according to section "P-P" in FIG. 3.

FIG. 4 shows a sectional view of a detail according to the line "P-P" of FIG. 3. The flow guiding part 5 is clearly visible here. According to the embodiment of the invention shown here, it is a plate-shaped part in the form of a trapezium. It is welded to the lower U-section of the collector 2 and projects with progressively reducing height into the expansion corrugation cavity 7. As a result, the cooling medium flowing into the orifice region 4 (arrow 14) is directed to the outer edge of the expansion corrugation 9, i.e. the nose 8. The flow direction then follows the arrow 15 toward the outlet. As regards the cooling effect, the upper region of an expansion corrugation 9 shown in cross-section in FIG. 4 extracts more heat from the insulating coolant than was hitherto the case with cooling radiators. It can also be seen from FIG. 4 that the upper collector 2 is constituted by two U-sections with their legs aligned to another. The collector cavity 3 is rectangular in cross-section. The flow part 5 is a metal piece welded to the lower of these U-sections.

Figure 5:
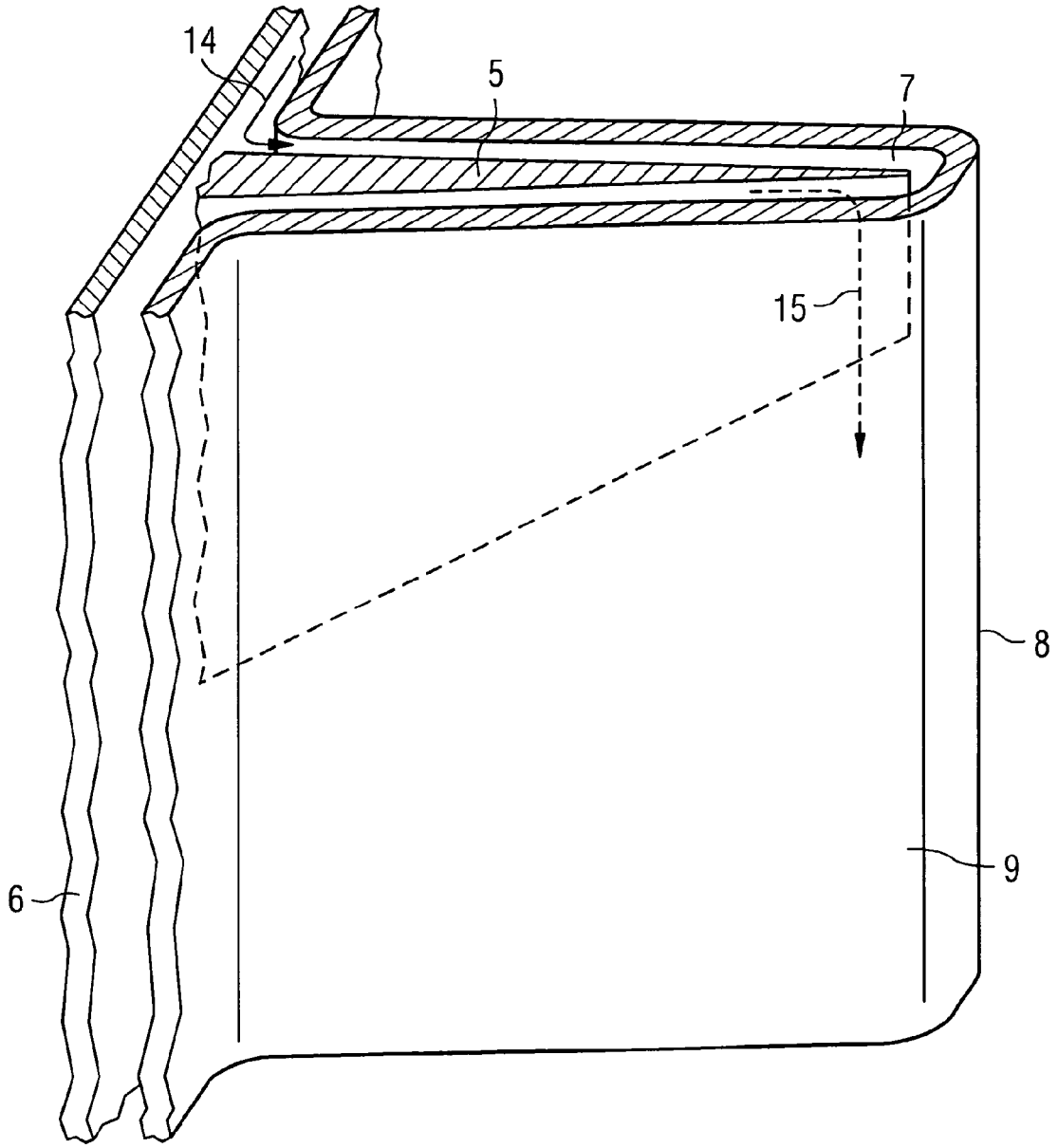
FIG. 5 shows a cutaway view of an expansion corrugation wherein the flow guiding part is wedge-shaped according to a particular embodiment of the invention.

FIG. 5 shows an enlarged cutaway spatial view of an expansion corrugation 9 and the associated cover sheet 6. The expansion corrugation 9 consists of a metal sheet bent through 180° (corrugated sheet or folded sheet), the two legs running virtually parallel up to the nose 8. Again visible in the expansion corrugation cavity 7 is the flow guiding part 5 which on the one hand tapers toward the nose 8, but on the other is trapezoidally shaped. This provides a particularly efficient means of directing the heat exchange medium (insulating coolant, e.g. transformer oil) flowing in in the direction of the arrow 14 to the outer edge of the expansion corrugation 8 acting as cooling fins, thereby improving the cooling effect.

Although the invention has been described and illustrated in detail with reference to the preferred exemplary embodiment described above, the invention is not limited by the examples disclosed. In particular, other variations may be inferred therefrom by the average person skilled in the art without departing from the scope of protection sought for the invention.

LIST OF REFERENCE CHARACTERS USED

1 expansion radiator
2 collector
3 collector cavity
4 orifice region
5 flow guiding part
6 cover sheet
7 expansion corrugation cavity
8 nose
9 expansion corrugation
10 arrow
11 welded seam
12, 13, 14, 15 flow direction

The invention claimed is:

1. An expansion radiator for a hermetically sealed electrical transformer or a choke, the expansion radiator comprising:

an inflow for receiving a supply of heat exchange fluid, said inflow being formed of two U-sections having legs aligned with one another;

an expansion corrugation and an associated cover part forming an expansion corrugation cavity for receiving the heat exchange fluid from said inflow;

a flow guiding part disposed in an orifice region formed between said inflow and said expansion corrugation cavity, said flow guiding part being a metal piece welded to one of said U-sections, said flow guiding part projecting into said expansion corrugation cavity and guiding a flow direction of the heat exchange fluid; and an outflow for receiving the heat exchange fluid from said expansion corrugation cavity and for draining off the heat exchange fluid.

2. The expansion radiator according to claim 1, wherein said flow guiding part is configured to direct the heat exchange fluid in a direction of a nose of said expansion corrugation.

3. The expansion radiator according to claim 2, wherein said flow guiding part is a trapezoidal plate-shaped part.

4. The expansion radiator according to claim 2, wherein said flow guiding part is wedge-shaped.

5. The expansion radiator according to claim 2, wherein said flow guiding part is a trapezoidal plate that tapers toward the nose.

6. The expansion radiator according to claim 1, wherein said flow guiding part is cone-shaped.

7. The expansion radiator according to claim 1, wherein said expansion corrugations are disposed symmetrically with respect to a plane of symmetry running through said inflow and said outflow.

8. The expansion radiator according to claim 7, wherein said expansion corrugation cavity is a corrugated sheet welded to a cover sheet.

9. The expansion radiator according to claim 1, wherein said orifice region is a rectangular slit formed in one of said U-sections.

10. In combination with an electrical distribution transformer incorporated in a power grid, the expansion radiator according to claim 1.

* * * * *